US012022942B2

(12) United States Patent
Hung

(10) Patent No.: US 12,022,942 B2
(45) Date of Patent: Jul. 2, 2024

(54) ADJUSTABLE READING STAND

(71) Applicant: CHEN-SOURCE INC., Taoyuan (TW)

(72) Inventor: Hsin-Yun Hung, Taoyuan (TW)

(73) Assignee: CHEN-SOURCE INC., Taoyuan (TW)

( * ) Notice: Subject to any disclaimer, the term of this patent is extended or adjusted under 35 U.S.C. 154(b) by 0 days.

(21) Appl. No.: 18/153,841

(22) Filed: Jan. 12, 2023

(65) Prior Publication Data

US 2024/0138562 A1 May 2, 2024

(30) Foreign Application Priority Data

Nov. 1, 2022 (TW) ..... 111211952

(51) Int. Cl.
*A47B 23/04* (2006.01)

(52) U.S. Cl.
CPC ..... *A47B 23/043* (2013.01); *A47B 23/042* (2013.01); *A47B 2023/049* (2013.01)

(58) Field of Classification Search
CPC .... G06F 1/1628; G06F 1/1626; G06F 1/1656; A45C 2011/003; A45C 2200/15; A47B 23/043; A47B 23/044; A47B 23/042; A47B 2220/0016; A47B 2220/0019; A47B 2023/049
USPC ..... 248/456
See application file for complete search history.

(56) References Cited

U.S. PATENT DOCUMENTS 2,165,255 A * 7/1939 Hamilton ..... A47B 23/043 248/455
2,204,881 A * 6/1940 Belleisle ..... A47B 23/042 248/459
2,224,530 A * 12/1940 Weinstein ..... A47B 23/043 248/456
2,374,409 A * 4/1945 Gallagher ..... A47B 23/043 248/456
2,587,316 A * 2/1952 Henry ..... B42D 3/16 206/45.24
3,121,576 A * 2/1964 Schade ..... B42F 13/402 248/441.1

(Continued)

FOREIGN PATENT DOCUMENTS

GB 2458737 A * 10/2009 ..... A47B 23/043
KR 950006193 Y1 * 8/1995 ..... A47B 23/06

(Continued)

*Primary Examiner* — Taylor Morris
(74) *Attorney, Agent, or Firm* — MUNCY, GEISSLER, OLDS & LOWE, P.C.

(57) ABSTRACT

An adjustable reading stand includes a base including two bottom plates foldable relative to each other, a resisting edge located on one side of the bottom plates and opposite limit grooves formed on the bottom plates, an butting member set on the bottom plates and providing an accommodating space near the resisting edge, and a positioning member having one side thereof set at the side of the accommodating space far from the resisting edge and an opposite side thereof provided with a retaining side that slides along the surface of the two bottom plates and embedded in any two opposite limit grooves. Thus, the inclination angle of the abutting member on the base can be adjusted, and the two bottom plates, the abutting member and the positioning member can be folded, so as to reduce the volume of the adjustable reading stand for convenient carrying.

8 Claims, 9 Drawing Sheets

(56) References Cited

U.S. PATENT DOCUMENTS 3,305,206 A * 2/1967 Nichols ..... A47B 23/043 248/459
3,381,928 A * 5/1968 White ..... A47B 23/043 248/455
4,323,214 A * 4/1982 DeLuca ..... A47B 23/043 248/452
4,460,146 A * 7/1984 Raggiotti ..... A47G 1/142 248/456
4,679,757 A * 7/1987 Mussari ..... A47B 23/043 248/463
4,722,504 A * 2/1988 Degenholtz ..... A47B 23/044 248/459
4,771,976 A * 9/1988 Su ..... A47B 23/043 248/172
4,776,552 A * 10/1988 March ..... A47B 23/044 248/455
4,852,498 A * 8/1989 Judd ..... A47B 23/043 190/11
5,149,047 A * 9/1992 Tucker ..... A47B 23/044 248/459
5,253,840 A * 10/1993 Sheremetta ..... A47B 23/043 248/455
5,290,002 A * 3/1994 Cohen ..... A47B 23/043 248/456
5,941,496 A * 8/1999 Banner ..... A47B 23/004 248/459
6,199,816 B1 * 3/2001 Case ..... A47B 23/042 248/460
6,237,887 B1 * 5/2001 Banner ..... A47B 23/004 248/459
6,543,949 B1 * 4/2003 Ritchey ..... A47B 21/0314 400/693
6,967,836 B2 * 11/2005 Huang ..... G06F 1/1628 361/679.55
7,537,192 B2 * 5/2009 Al-Haleem ..... A47B 23/044 248/455
7,545,634 B2 * 6/2009 Simonian ..... F16M 11/38 361/679.55
7,561,415 B2 * 7/2009 Liou ..... G02F 1/1323 361/679.26
7,758,009 B1 * 7/2010 Chang ..... A47B 23/044 248/456
7,770,864 B2 * 8/2010 Phifer ..... A47B 23/043 248/455
8,100,376 B2 * 1/2012 Ye ..... F16M 13/00 248/455
8,534,619 B2 * 9/2013 Huang ..... F16M 13/00 248/463
8,714,351 B2 * 5/2014 Toulotte ..... A47B 23/043 206/45.24
8,844,892 B2 * 9/2014 Robinson ..... A47B 23/043 248/455
9,377,810 B2 * 6/2016 Hishinuma ..... G06F 1/1613
9,998,166 B2 * 6/2018 Kim ..... A47B 23/043
11,209,870 B1 * 12/2021 Li ..... G06F 3/03547
11,332,954 B1 * 5/2022 Chase ..... E04H 15/58
11,484,115 B2 * 11/2022 Orona ..... B42D 17/00
2004/0240164 A1 * 12/2004 Lee ..... G06F 1/1616 361/679.55
2008/0029412 A1 * 2/2008 Ho ..... F16M 11/2014 361/679.55
2008/0230672 A1 * 9/2008 Pachowski ..... A47B 23/044 248/459
2009/0179132 A1 * 7/2009 Qin ..... A47B 23/043 248/371
2010/0155458 A1 * 6/2010 Pecci ..... B42F 7/14 229/67.1
2011/0048597 A1 * 3/2011 Ho ..... G06F 1/1632 150/165
2011/0180682 A1 * 7/2011 Tarnutzer ..... A47B 23/043 248/447
2015/0374118 A1 * 12/2015 van Hooft ..... F16M 11/10 248/451
2020/0121074 A1 * 4/2020 Orona ..... B42D 3/126
2020/0208773 A1 * 7/2020 Lin ..... H04B 1/3888
2022/0202179 A1 * 6/2022 Lin ..... A47B 23/044
2023/0020938 A1 * 1/2023 Liu ..... A47B 23/043

FOREIGN PATENT DOCUMENTS

KR 200348257 Y1 * 4/2004 ..... A47B 23/043
WO WO-2004006717 A1 * 1/2004 ..... A47B 21/0314
WO WO-2012033256 A1 * 3/2012 ..... A47B 23/043

* cited by examiner

ADJUSTABLE READING STAND

This application claims the priority benefit of Taiwan patent application number 111211952, filed on Nov. 1, 2022.

BACKGROUND OF THE INVENTION

1. Field of the Invention

The present invention relates to reading stands and more particularly, to an adjustable reading stand that can be folded and stored. By movably combining the abutting member on one side of the base and the positioning member on the abutting member, the base, the abutting member and the positioning member can be folded, so as to reduce the volume of the adjustable reading stand and facilitate portable applications.

2. Description of the Related Art

When you want to read documents, you usually read them by holding the documents with one or both hands. However, if you read for a long time, it will cause arm soreness and fatigue. In order to facilitate the reading of documents, the documents can be placed on the reading stand to avoid arm soreness caused by holding documents with one hand or both hands. However, in order to place various books, documents or materials in the general reading stands currently used, the shelf area of the reading stands is relatively wide, which will occupy more space when applied. When the reading stand is not in use, although the reading stand can be folded into a flat shape, the surface area of the reading stand is still large, which is not conducive to storage, and is not convenient for carrying and application, so the application of the reading stand is not common.

With the continuous advancement of electronic technology, many electronic products such as smartphones, tablet computers or notebook computers have become indispensable in most people's daily life and are carried around and used quite frequently. However, electronic products such as smartphones or tablet computers are all thin and flat, and cannot be used in a standing position. The user must hold the smartphone or tablet of the electronic product with one hand, and operate the electronic product with the other hand. If the operation is used for a long time, the user's hands will be easily sore and tired. There are brackets for placing electronic products in the market, but the area of the electronic products is small, so the volume of the bracket is not large, and it can only be used for placing smartphones, and it is easy to cause an unstable center of gravity, and the supporting effect is not ideal. When electronic products such as smartphones are placed on the stand, when the user operates the electronic product by hand, the bracket on which the electronic product is placed is often pushed, displaced, tilted or pushed down. Furthermore, although the bracket for electronic product applications is small in size, it can be used for carrying. However, due to its small size and unstable center of gravity, it is easy to be collided and pushed by external forces when placed on a plane, and it is also easy for electronic products placed on the stand to be collided, pushed, etc., or even fall to the ground. Therefore, the use of brackets for electronic product applications is not ideal.

The general reading stands are large in size, and most of them are used for placing various documents and materials. Therefore, the reading stands are all hard surfaces, which are not conducive to the use of reading stands for small smartphones or tablets, etc. In addition to the inappropriate size ratio, the hard surface of the reading stand is prone to friction and collision with the surface of electronic products such as smartphones and tablet computers, resulting in scratches, paint peeling or depressions on the surface of electronic products. As for the brackets used in general electronic products, they are small in size and cannot provide larger documents for placement. Then, whether it is a reading stand or an electronic product bracket, the application mode is more limited, the commonality is poor, and the practicability is also poor. Users must purchase different reading stands and electronic product brackets at the same time, which is not economical.

Therefore, how to solve the problems and troubles that the reading stands and electronic product brackets are not easy to carry or are unstable in practical application, and can only be used for a single application mode and cannot be expanded is the direction the relevant manufacturers in this industry are eager to study and improve.

SUMMARY OF THE INVENTION

The present invention has been accomplished under the circumstances in view. It is the main object of the present invention to provide an adjustable reading stand comprising a base, an abutting member and a positioning member. The base comprises two opposite bottom plates, a folding groove to be used for the two bottom plates to be relatively folded along the folding groove of the base, a resisting edge located on one side of the two bottom plates and the folding groove, and a plurality of limit grooves formed on the surface of the two bottom plates and respectively extending toward the folding groove of the base. The abutting member is set on the bottom plates at an inner side of the resisting edge of the base, comprising a hollow-shaped accommodating space arranged at the center position of one side thereof near the resisting edge and a folding groove arranged on the surface thereof corresponding to the folding groove of the base. The positioning member has one side thereof set at the side of the accommodating space of the abutting member far from the resisting edge and an opposite side thereof provided with a retaining side that slides along the surface of the two bottom plates and embedded in any two opposite limit grooves. The positioning member comprises a folding groove arranged on the surface thereof corresponding to the folding groove of the abutting member and the folding groove of the base. Thus, the inclination angle of the abutting member on the base can be adjusted, and the two bottom plates, the abutting member and the positioning member can be folded, so as to reduce the volume of the adjustable reading stand for convenient carrying.

It is another object of the present invention to provide an adjustable reading stand, wherein the bottom plates of the base are made of metal material (such as iron, steel, copper or metal alloy, etc.) or hard non-metallic material (such as plastic, silicone, rubber or wood, etc.) and respectively covered with a bottom bushing of insulating material; the abutting member comprises an inner plate made of metal material (such as iron, steel, copper or metal alloy, etc.) or hard non-metallic material (such as plastic, silicone, rubber or wood, etc.), and an outer bushing of insulating material covering the outside of the inner plate and movably combined with the bottom bushings that cover said two bottom plates on the inner side of the resisting edge. Furthermore, the bottom bushings and the outer bushing are soft materials such as insulating fabrics, plastic sleeves, silicone sleeves or rubber sleeves, respectively. The outer bushing has one side thereof movably joined to the bottom bushings by stitching, hot melting or gluing. The bottom bushing of one of the bottom plates of the base has an outer edge thereof extended with a fixing member with a magnetic element, so that the two bottom plates are adsorbed by the magnetic elements on the fixing members after the two bottom plates are folded relative to each other along the folding groove of the base, thereby achieving the purpose of reducing the volume of the base and abutting member and having the effect of being convenient for carrying and application.

It is still another object of the present invention to provide an adjustable reading stand, wherein the resisting edge on one side of the base is made of insulating plastic, silicone, rubber or sponge.

It is still another object of the present invention to provide an adjustable reading stand, wherein the positioning member is made of metal material (such as iron, steel, copper or metal alloy, etc.) or hard non-metallic material (such as plastic, silicone, rubber or wood, etc.) and externally covered with a hood bushing. The hood bushing is soft insulating material such as cloth, plastic sleeve, silicone sleeve or rubber sleeve. The hood bushing has one side thereof movably combined with the outer bushing on the side of the accommodating space of the abutting member by means of sewing, hot melting or gluing.

It is still another object of the present invention to provide an adjustable reading stand, wherein the abutting member is provided with a hollow-shaped receiving space on the other side of the abutting member opposite to the accommodating space; one side of the receiving space near the accommodating space is movably combined with a latching member; the latching member has a docking member with a magnetic element respectively extended from each of two sides thereof, the surface of the latching member is provided with a folding groove corresponding to the folding groove of the abutting member and the folding groove of the positioning member. The abutting member is respectively provided with opposite support members on two side surfaces of the folding groove of the abutting member. Each support member has one side thereof combined with the surface of the abutting member, and an opposite side thereof connected with an extension belt. The extension belt has one side thereof combined with the abutting member. The latching member is made of metal material (such as iron, steel, copper or metal alloy, etc.) or hard non-metallic material (such as plastic, silicone, rubber or wood, etc.). The latching member has one side thereof movably combined with one side of the receiving space of the abutting member through stitching, hot melting or gluing selectively.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

In order to achieve the above purpose and effect, the technical means used in the present invention and its structure, implementation method, etc., the preferred embodiments of the present invention are hereby described in detail and their features and functions are as follows, so as to be fully understood.

Figure 1:
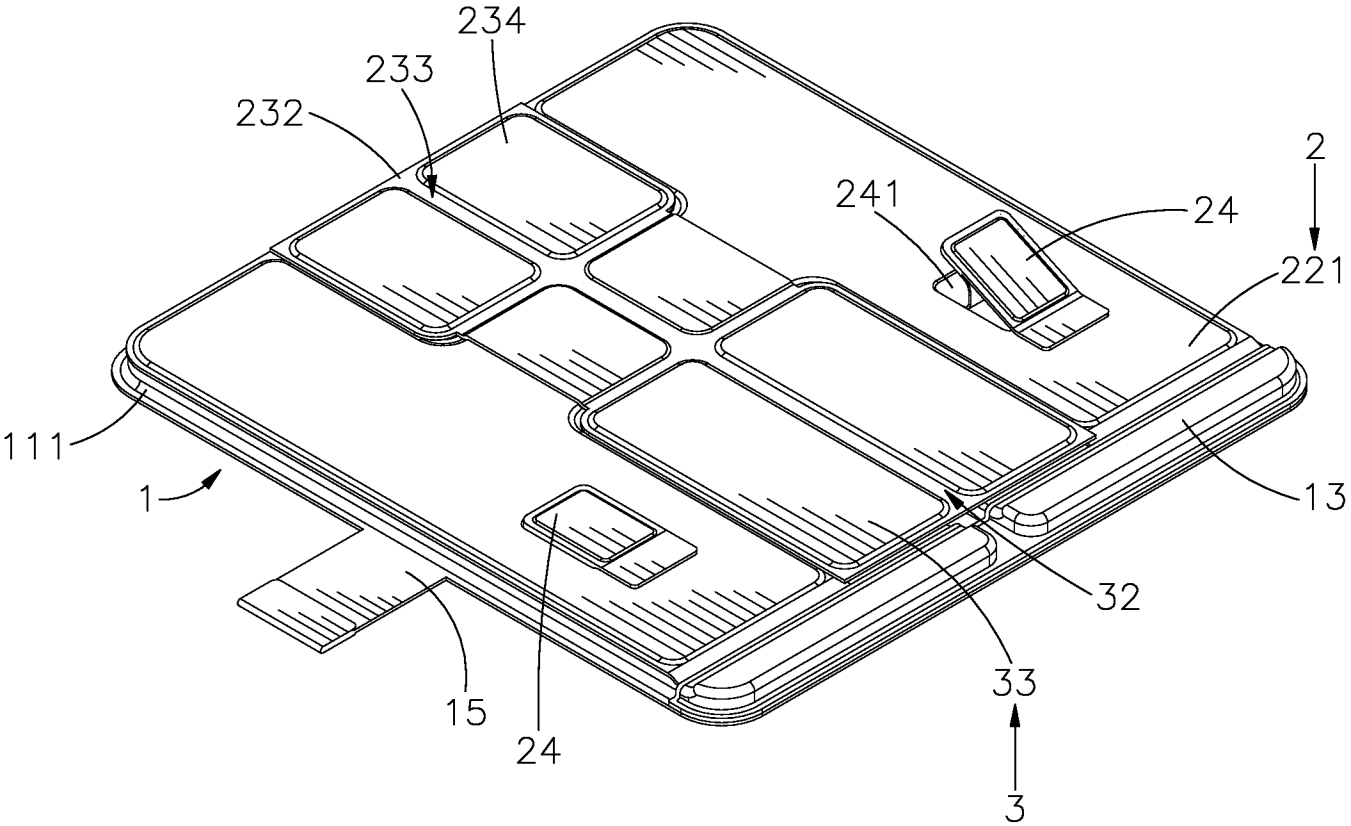
FIG. 1 is a three-dimensional appearance view of the present invention.
Figure 2:
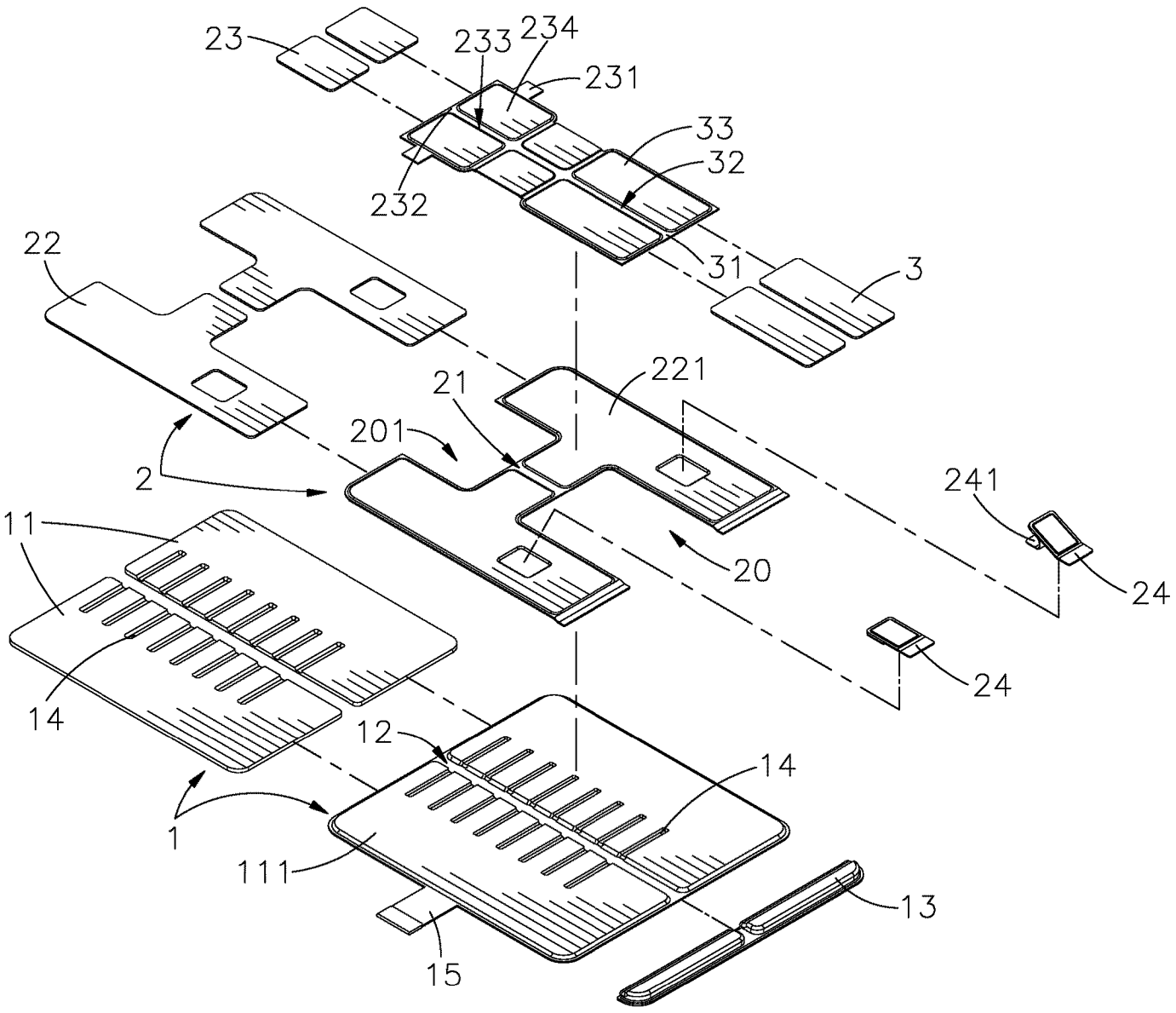
FIG. 2 is a three-dimensional exploded view of the present invention.
Figure 3:
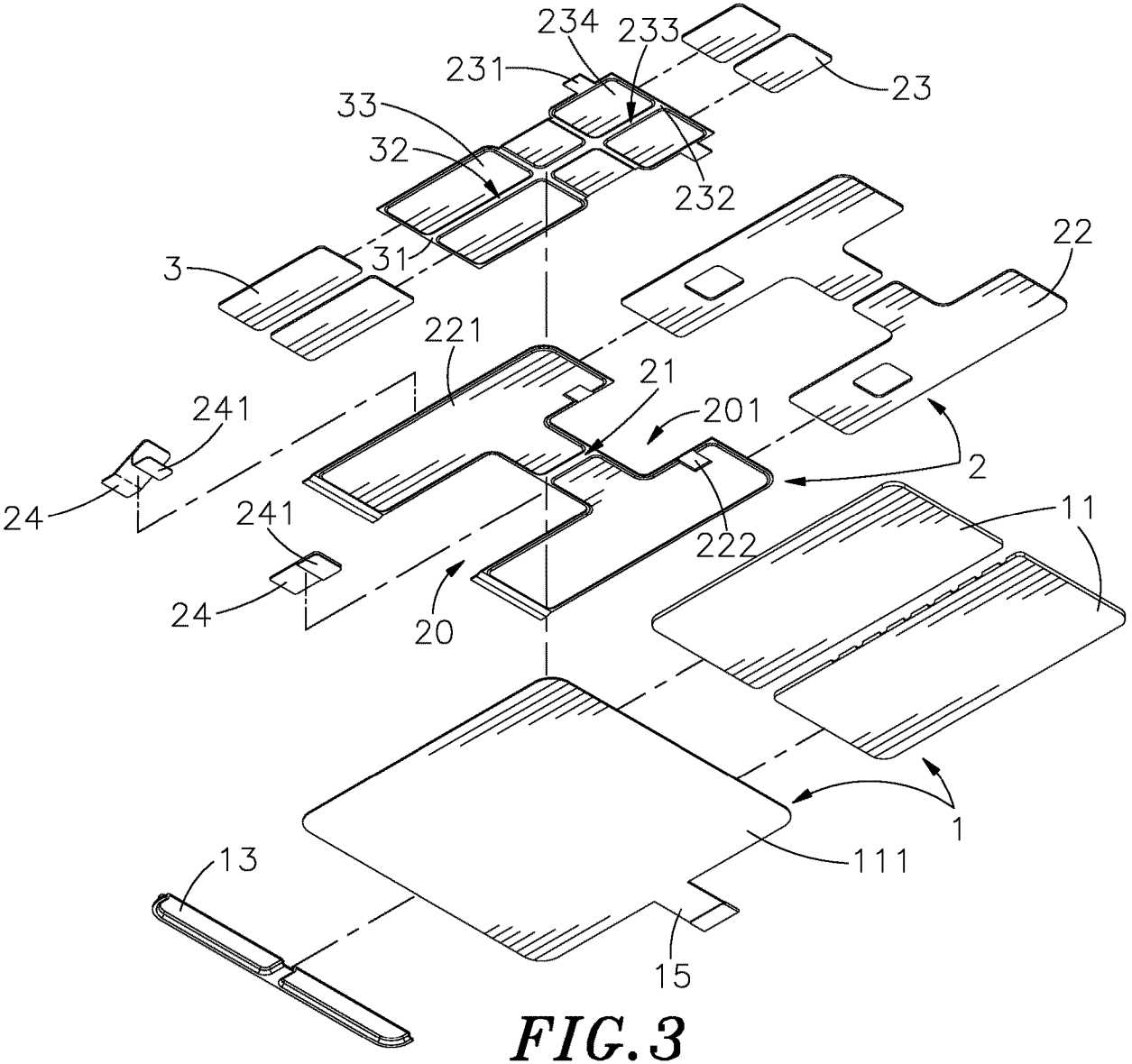
FIG. 3 is a three-dimensional exploded view of the present invention from another perspective.
Figure 4:
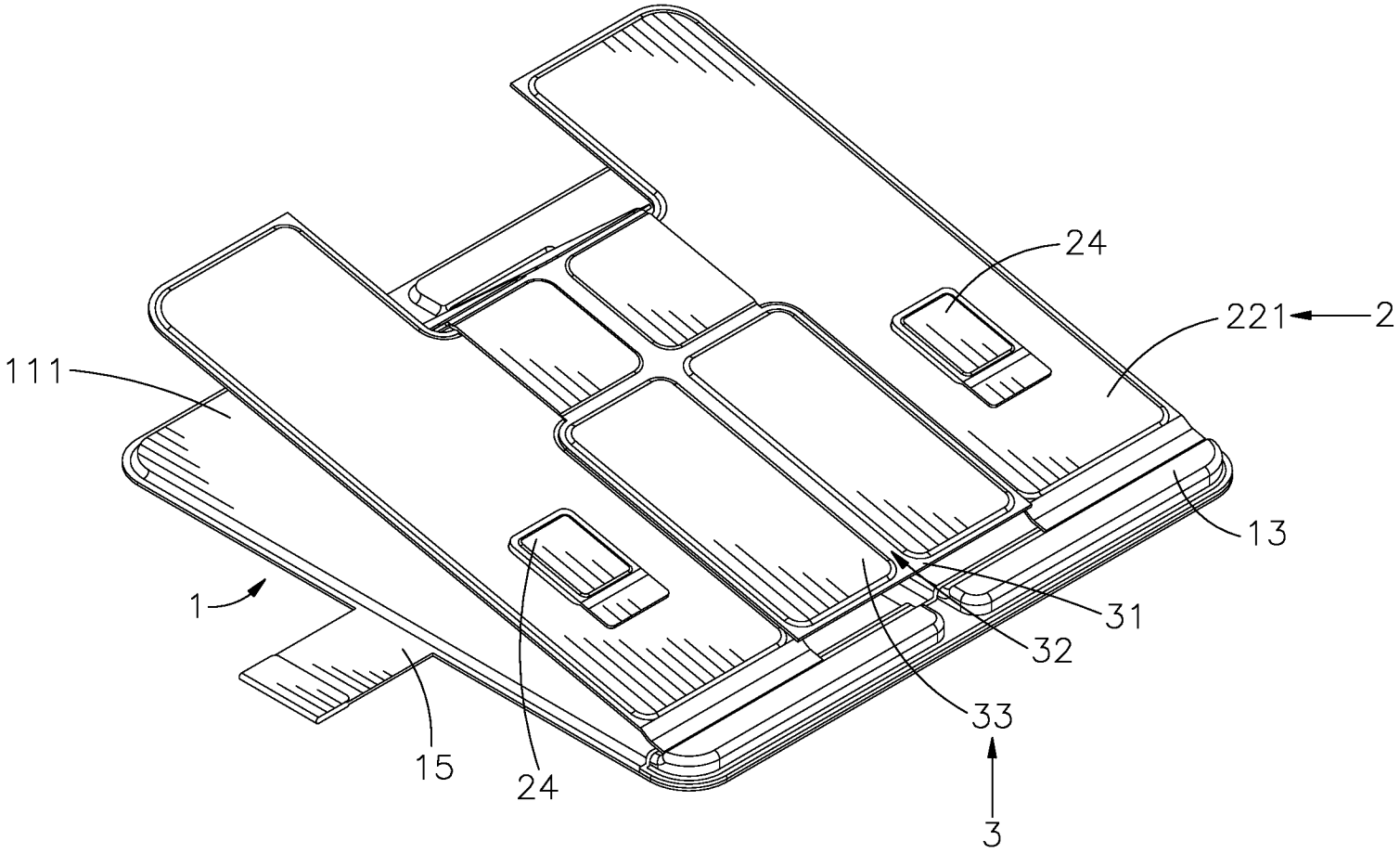
FIG. 4 is a three-dimensional external view of the first embodiment implementation of the present invention.
Figure 5:
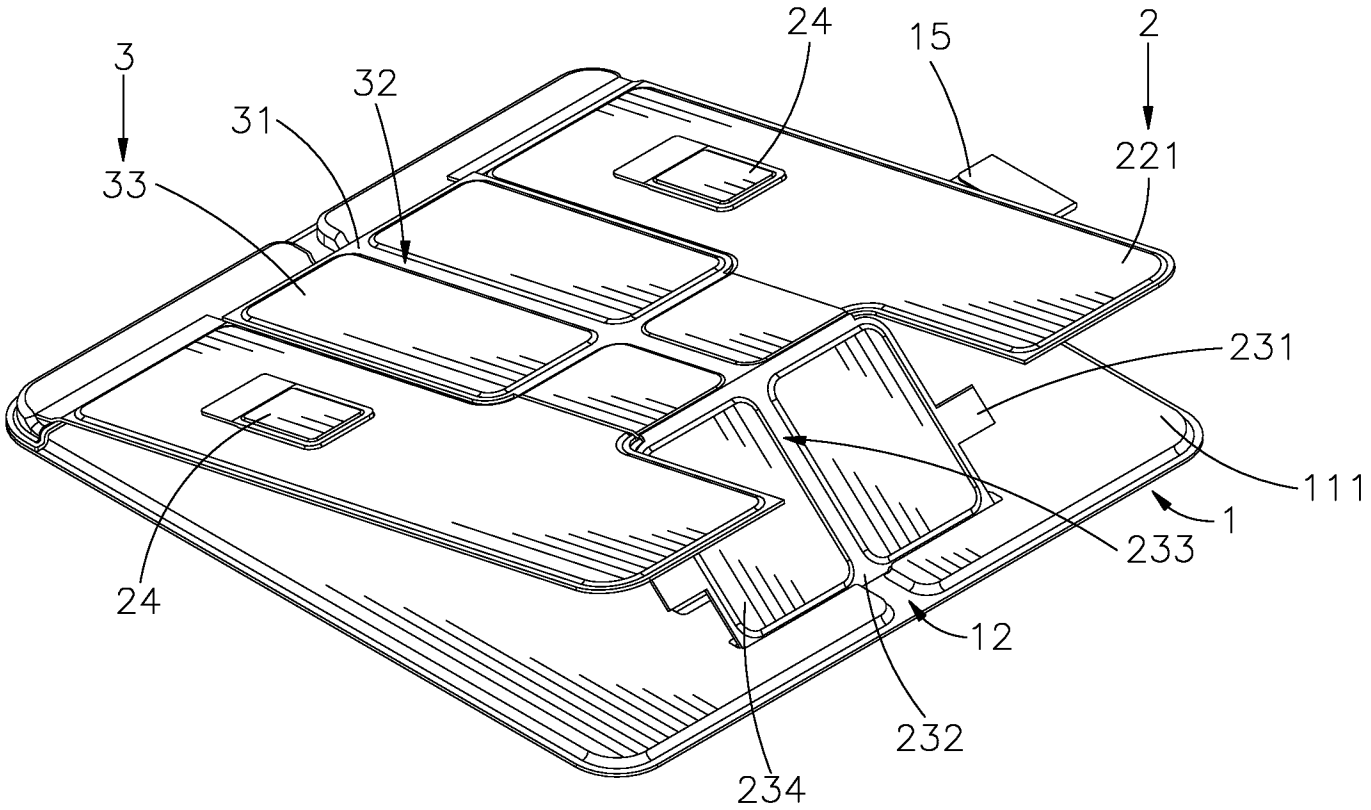
FIG. 5 is a three-dimensional external view of the second embodiment implementation of the present invention.
Figure 6:
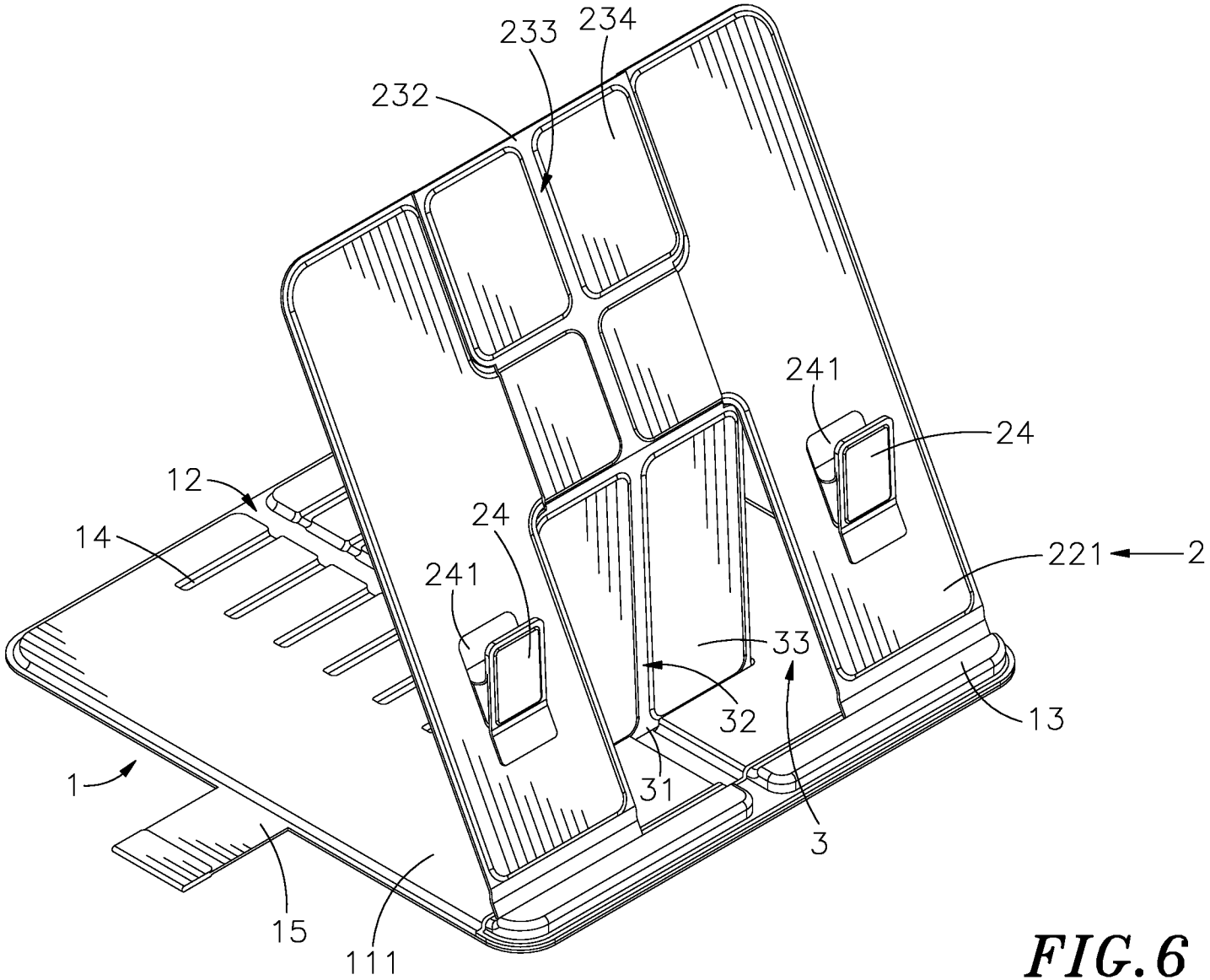
FIG. 6 is a three-dimensional external view of the third embodiment implementation of the present invention.
Figure 7:
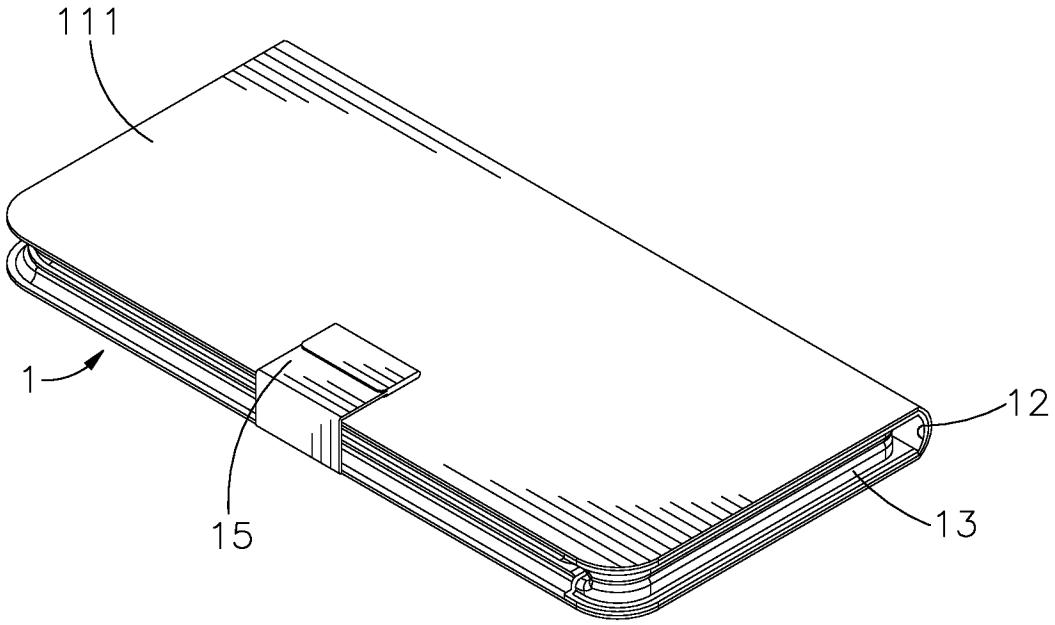
FIG. 7 is a three-dimensional external view of the fourth embodiment implementation of the present invention.
Figure 8:
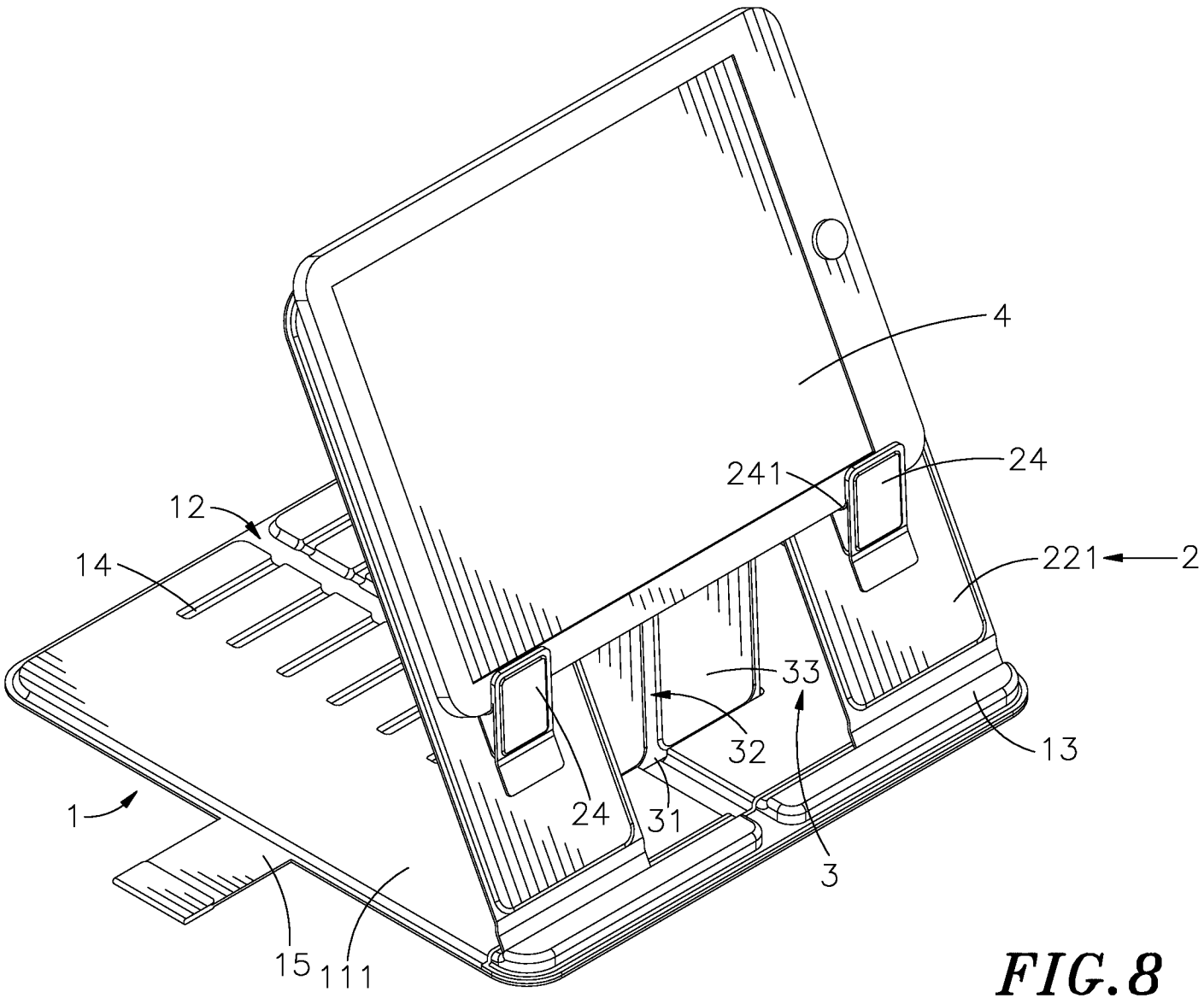
FIG. 8 is a three-dimensional external view of the fifth embodiment implementation of the present invention.
Figure 9:
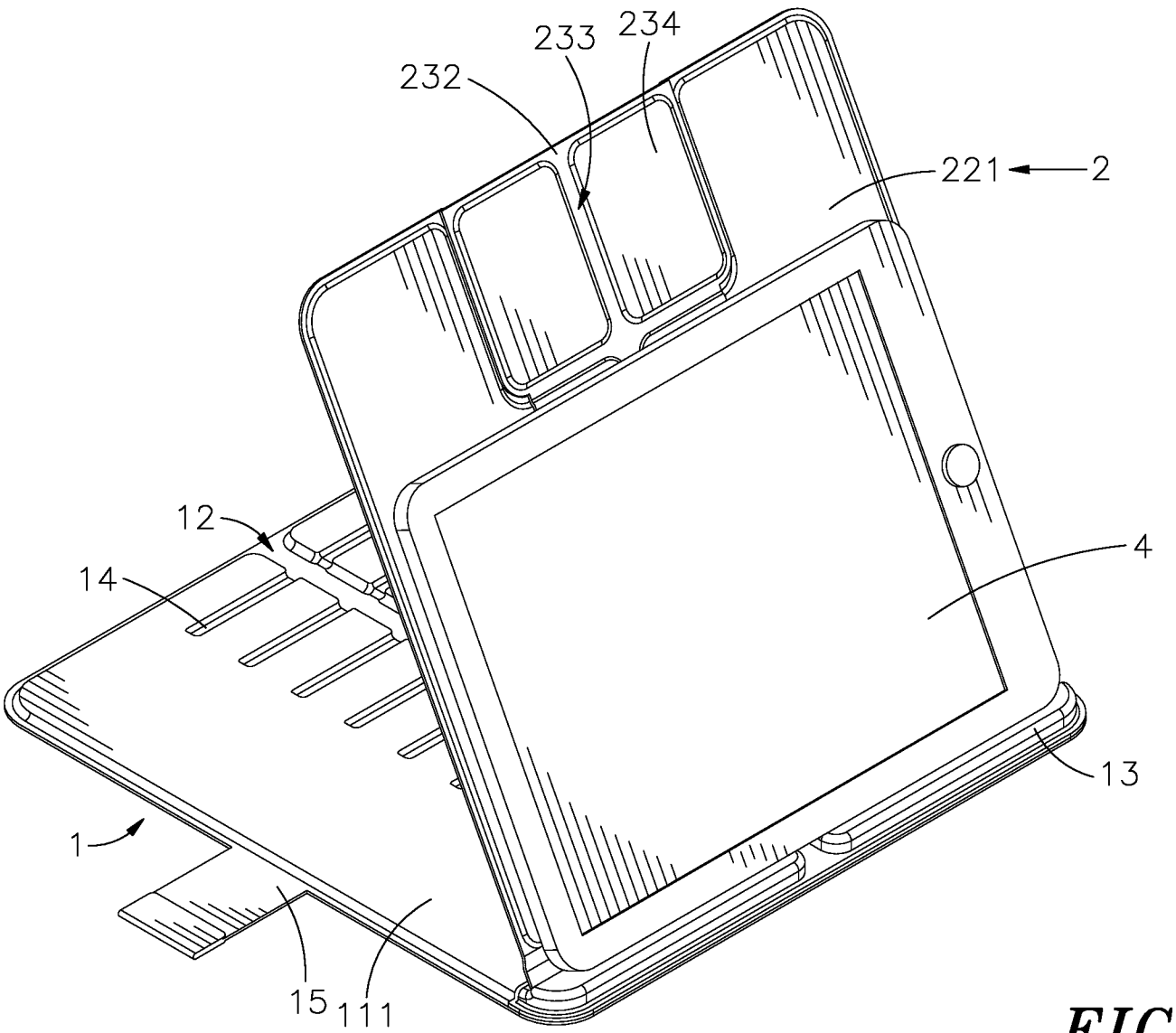
FIG. 9 is a three-dimensional external view of the sixth embodiment implementation of the present invention.

Please refer to FIGS. 1, 2, and 3, which are an appearance view, an exploded view, and an exploded view from another perspective of the present invention. As shown in the drawings, it can be clearly seen that the adjustable reading stand of the present invention comprises a base 1, an abutting member 2 and a positioning member 3.

The base 1 comprises two opposite bottom plates 11, a folding groove 12, which can be used for the two bottom plates 11 to be relatively folded along the folding groove 12, a resisting edge 13 located on one side of the two bottom plates 11 and the folding groove 12, and a plurality of limit grooves 14 formed on the surface of the two bottom plates 11 and respectively extending toward the folding groove 12.

The abutting member 2 is movably set on the bottom plates 11 at the inner side of the resisting edge 13 of the base 1. A hollow-shaped accommodating space 20 is arranged at the center position of one side of the abutting member 2 near the resisting edge 13, and a folding groove 21 is arranged on the surface of the abutting member 2. The folding groove 21 corresponds to the folding groove 12 between the two bottom plates 11.

The positioning member 3 has one side thereof set at the side of the accommodating space 20 of the abutting member 2 far from the resisting edge 13 and an opposite side thereof provided with a retaining side 31 that slides along the surface of the two bottom plates 11 and embedded in any two opposite limit grooves 14. The positioning member 3 comprises a folding groove 32 arranged on the surface thereof corresponding to the folding groove 21 of the abutting member 2 and the folding groove 12 of the base 1.

The above base 1 with the two opposite bottom plates 11 can be made of metal materials (such as iron, steel, copper or metal alloy, etc.) or hard non-metallic materials (such as plastic, silicone, rubber or wood, etc.). The outside of the two bottom plates 11 can be respectively covered with bottom bushings 111 of insulating material, and a concave limit groove 14 is formed at the center position of the bottom bushings 111 opposite to the inner side of the two bottom plates 11. The abutting member 2 comprises an inner plate 22 and an outer bushing 221 of insulating material covering the outside of the inner plate 22. The inner plate 22 can be made of metal material (such as iron, steel, copper or metal alloy, etc.) or hard non-metallic material (such as plastic, silicone, rubber or wood, etc.). The outer bushing 221 covering the outer side of the inner plate 22 can be movably combined with the bottom bushings 111 that cover the two bottom plates 11 on the inner side of the resisting edge 13. The bottom bushings 111 and the outer bushing 221 can be soft materials such as insulating fabrics, plastic sleeves, silicone sleeves or rubber sleeves, respectively. One side of the outer bushing 221 can be movably joined to the bottom bushings 111 by stitching, hot melting or gluing. The outer edge of the bottom bushing 111 of one of the bottom plates 11 of the base 1 is extended with a fixing member 15 with a magnetic element (not shown), so that the two bottom plates 11 can be adsorbed by the magnetic element on the fixing member 15 after the two bottom plates 11 are folded relative to each other along the folding groove 12, so as to achieve the purpose of reducing the volume of the base 1 and the abutting member 2, and have the effect of being convenient to carry and easy to apply.

The above-mentioned resisting edge 13 on one side of the base 1 can be made of soft materials such as insulating plastic, silicone, rubber or sponge.

Furthermore, the above-mentioned abutting member 2 may be further provided with a hollow-shaped receiving space 201 on the other side of the abutting member 2 opposite to the accommodating space 20, and a docking slot 222 is respectively provided on both sides of the receiving space 201, and one side of the receiving space 201 near the accommodating space 20 is combined with a latching member 23. The latching member 23 can be made of metal material (such as iron, steel, copper or metal alloy, etc.) or hard non-metallic material (such as plastic, silicone, rubber or wood, etc.). A docking member 231 with a magnetic element (not shown) is respectively extended on each of two sides of the latching member 23, so that the two docking members 231 can be inserted into the docking slots 222 at the two sides of the receiving space 201 respectively to form a limit. One side of the latching member 23 outside the receiving space 201 is provided with a fitting edge 232 for being sucked on the abutting member 2 on the two sides of the receiving space 201. A folding groove 233 is provided on the surface of the latching member 23, so that the folding groove 233 can be positioned in the folding groove 21 of the abutting member 2 and a folding groove 32 of the positioning member 3. The abutting member 2 is respectively provided with opposite support members 24 on the two side surfaces of the folding groove 21. One side of each support member 24 is combined with the surface of the abutting member 2, and the other side is respectively connected with an extension belt 241, and one side of the extension belt 241 is combined with the abutting member 2. The latching member 23 can be made of hard insulating materials (such as plastic, silicone, rubber or wood, etc.). One side of the latching member 23 can be combined with one side of the receiving space 201 of the abutting member 2 by hot melting or gluing. The latching member 23 of the abutting member 2 movably connected at the receiving space 201 can be covered with a covering bushing 234. The covering bushing 234 can be soft insulating material such as cloth, plastic sleeve, silicone sleeve or rubber sleeve and other soft materials. One side of the covering bushing 234 can be movably combined with the outer bushing 221 on the side of the receiving space 201 of the abutting member 2 by stitching, hot melting or gluing.

The above-mentioned positioning member 3 can be made of metal material (such as iron, steel, copper or metal alloy, etc.) or hard non-metallic material (such as plastic, silicone, rubber or wood, etc.). The outside of the positioning member 3 can be covered with a hood bushing 33. The hood bushing 33 can be soft insulating material such as cloth, plastic sleeve, silicone sleeve or rubber sleeve and other soft materials. One side of the hood bushing 33 can be movably combined with the position of the outer bushing 221 on the side of the accommodating space 20 of the abutting member 2 by means of sewing, hot melting or gluing.

Please refer to FIGS. 1, 2, 3, 4, 5, 6, 7, 8, and 9, which are the three-dimensional appearance view of the present invention, the three-dimensional exploded view of the present invention, the three-dimensional exploded view of the present invention from another perspective, the three-dimensional external view of the first embodiment implementation of the present invention, the three-dimensional external view of the second embodiment implementation of the present invention, the three-dimensional external view of the third embodiment implementation of the present invention, the three-dimensional external view of the fourth embodiment implementation of the present invention, the three-dimensional external view of the fifth embodiment implementation of the present invention, and the three-dimensional external view of the sixth embodiment implementation of the present invention.

As shown in the drawings, it can be clearly seen that when the above-mentioned adjustable reading stand of the present invention is applied in practice, swing the abutting member 2 of the inner side of the resisting edge 13 of the base 1 to a proper inclination angle, then use the internal positioning member 3 in the accommodating space 20 of the abutting member 2 to slide and displace along the plurality of two opposite limit grooves 14 of the base 11 with the retaining side 31 of the internal positioning member 3, allowing the retaining side 31 to be embedded in any two opposite limit grooves 14, so that the abutting member 2 is located on the base 1 to form an appropriate inclination angle. That is, the preset object 4 (such as books, documents or paper materials, or electronic products such as tablet computers or smartphones, etc.) can be placed on the resisting edge 13 for the preset object 4 to be stably placed on the base 1 and the abutting member 2. In addition, the bottom bushings 111 of the two bottom plates 11 and the resisting edge 13 of the base 1 are also made of soft material, and the outer bushing 221 of the inner plate 21 of the abutting member 2 and the covering bushing 234 of the latching member 23 can provide a soft and elastic buffering effect, so that the base 1, the abutting member 2 and the positioning member 3 will not collide, scratch or rub against the external surface of the preset object 4 (such as smartphones or tablet computers of electronic products). Thus, the exterior of the preset object 4 will not be dented, painted or scratched, so as to achieve the purpose of protecting the preset object 4.

Furthermore, the two support members 24 can be moved and separated to the outside of the abutting member 2 respectively, and the two sides of the extension belts 241 for the two support members 24 can be respectively connected to the support members 24 and the abutting member 2. Thus, the preset object 4 (such as books, documents or paper and other documents, or electronic products such as tablet computers or smartphones, etc.) can be placed on the extension belts 241 of the two support members 24, and the preset object 4 can be adjusted. It can adjust the height position of the preset object 4, and provide the preset object 4 of different sizes to be placed on the resisting edge 13 or the two extension belts 241 (please also refer to FIG. 8). With the placement of different heights, it is convenient to read or operate and apply the preset object 4, which has functions and advantages such as practicability and convenience.

The above-mentioned abutting member 2 can be respectively slid by the positioning member 3 and the latching member 23 along the opposite limit grooves 14 on the base 1 in different directions, so that the retaining side 31 of the positioning member 3 and the fitting edge 232 of the latching member 23 can be respectively embedded in any two opposite limit grooves 14. That is, it can be used for the adjustment of multi-directional and multi-angle changes such as different directions, inclination angles and positions of the abutting member 2 on the base 1. That is, when the preset object 4 is placed on the base 1 and the abutting member 2, it is convenient to adjust and change different application methods, so as to improve the practicability and reliability of the present invention.

In addition, the above-mentioned abutting member 2 can lie flat and close to the top of the base 1 at an appropriate inclination angle (the inclination angle is less than 180°, about 120°~170°). The docking members 231 on the two sides of the latching member 23 at the receiving space 201 can then be separated from the docking slots 222 on the two sides of the receiving space 201 on the abutting member 2, respectively. Through sliding displacement of the fitting edge 232 of the latching member 23 along the plurality of two opposite limit grooves 14 on the base 1, the fitting edge 232 is then embedded in any two opposite limit grooves 14 to form an embedded position, for the abutting member 2 to lie on the base 1 in a near-flat position to form a proper inclination angle (the inclination angle is less than 180°, about 120°~170°. The preset object 4 (such as books, documents or paper and other documents, or electronic products such as tablet computers or smartphones, etc.) can then be placed on the resisting edge 13 and the inner abutting member 2. It provides the preset object 4 with different placement positions, angles, etc., to facilitate operation, application or reading, etc.

When the above base 1, the abutting member 2 and the positioning member 3 are not used, the abutting member 2 and the positioning member 3 can be placed flat against the base 1, then the folding groove 21 of the abutting member 2, the folding groove 32 of the positioning member 3, and the folding groove 233 of the latching member 23 are all aligned with the folding groove 12 of the base 1, so that the two sides of the base 1, the abutting member 2, the positioning member 3 and the latching member 23 can be folded relative to each other along the folding groove 12, the folding groove 21, the folding groove 32, and the folding groove 233. Then, the inner magnetic element of the fixing member 15 of the bottom plate 11 on one side of the base 1 is adsorbed on the other bottom plate 11. In this way, the base 1, the abutting member 2, the positioning member 3 and the latching member 23 can be folded into smaller volume (please also refer to FIG. 7), which can be easily stored and carried.

The above description is only one preferred embodiment of the present invention, which is not intended to limit the scope of the invention. All simple modifications and equivalent structural changes made by using the contents of the description and drawings of the present invention shall be similarly included in the patent scope of the present invention.

What the invention claimed is:

1. An adjustable reading stand, comprising:

a base, said base comprising two opposite bottom plates, a folding groove to be used for said two bottom plates to be relatively folded along the folding groove of said base, a resisting edge located on one side of said two bottom plates and said folding groove, and a plurality of limit grooves formed on an upper surface of each of said two bottom plates and respectively extending toward the folding groove of said base;

an abutting member set on said bottom plates at an inner side of said resisting edge of said base, said abutting member comprising a hollow-shaped accommodating space arranged at a center position of one side thereof near said resisting edge, and a folding groove arranged on a surface thereof corresponding to the folding groove of said base; and a positioning member having one side thereof set at the side of said hollow-shaped accommodating space of said abutting member far from said resisting edge and an opposite side thereof provided with a retaining side that is configured to slide along the upper surface of said two bottom plates and be embedded in any two opposite said limit grooves, said positioning member comprising a folding groove arranged on surface thereof corresponding to the folding groove of said abutting member and the folding groove of said base;

wherein said abutting member is provided with a hollow-shaped receiving space on another side of said abutting member opposite to said hollow-shaped accommodating space, one side of said receiving space near said hollow-shaped accommodating space being movably combined with a latching member, said latching member having a docking member with a magnetic element respectively extended from each of two sides thereof, a surf ace of said latching member being provided with a folding groove corresponding to the folding groove of said abutting member and the folding groove of said positioning member.

2. The adjustable reading stand as claimed in claim 1, wherein said bottom plates of said base are selectively made of metal material or hard non-metallic material and respectively covered with a bottom bushing of insulating material; said abutting member comprises an inner plate and an outer bushing of insulating material covering the outside of said inner plate, said inner plate being made of metal material or hard non-metallic material, said outer bushing being movably combined with said bottom bushing that cover said two bottom plates on the inner side of said resisting edge.

3. The adjustable reading stand as claimed in claim 2, wherein said bottom bushing and said outer bushing are soft materials selected from a group consisting of insulating fabrics, plastic sleeves, silicone sleeves and rubber sleeves; said outer bushing has one side thereof movably joined to said bottom bushing by stitching, hot melting or gluing.

4. The adjustable reading stand as claimed in claim 2, wherein the bottom bushing of one of said bottom plates of said base has an outer edge thereof extended with a fixing member with a magnetic element, so that said two bottom plates are adsorbed by said magnetic elements on said fixing member after said two bottom plates are folded relative to each other along the folding groove of said base.

5. The adjustable reading stand as claimed in claim 1, wherein said resisting edge on one side of said base is selectively made of insulating plastic, silicone, rubber or sponge.

6. The adjustable reading stand as claimed in claim 1, wherein said positioning member is selectively made of metal material or hard non-metallic material and externally covered with a hood bushing, said hood bushing being soft insulating material selected from a group consisting of cloth, plastic sleeve, silicone sleeve and rubber sleeve, said hood bushing having one side thereof movably combined with said outer bushing on the side of said hollow-shaped accommodating space of said abutting member by means of sewing, hot melting or gluing.

7. The adjustable reading stand as claimed in claim 1, wherein said latching member is selectively made of metal material or hard non-metallic material, said latching member having one side thereof movably combined with one side of said receiving space of said abutting member through stitching, hot melting or gluing selectively.

8. The adjustable reading stand as claimed in claim 1, wherein said abutting member is respectively provided with opposite support members on two side surfaces of the folding groove of said abutting member, each said support member having one side thereof movably combined with the surface of said abutting member and an opposite side thereof connected with an extension belt, said extension belt having one side thereof combined with said abutting member.

* * * * *